US010446357B2

(12) United States Patent
Douglass et al.

(10) Patent No.: US 10,446,357 B2
(45) Date of Patent: Oct. 15, 2019

(54) POWER FUSE AND FABRICATION METHODS WITH ENHANCED ARC MITIGATION AND THERMAL MANAGEMENT

(71) Applicant: EATON INTELLIGENT POWER LIMITED, Dublin (IE)

(72) Inventors: Robert Stephen Douglass, Wildwood, MO (US); Sidharta Wiryana, Kowloon (HK); Duren Huang, Shanghai (CN); Dacheng Feng, Shanghai (CN); Calvin Yang, Shanghai (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 153 days.

(21) Appl. No.: 14/956,447

(22) Filed: Dec. 2, 2015

(65) Prior Publication Data

US 2016/0343531 A1 Nov. 24, 2016

Related U.S. Application Data

(60) Provisional application No. 62/086,472, filed on Dec. 2, 2014.

(51) Int. Cl.

| | |
|---|---|
| ***H01H 85/38*** | (2006.01) |
| ***H01H 85/08*** | (2006.01) |
| ***H01H 85/18*** | (2006.01) |
| ***H01H 69/02*** | (2006.01) |
| ***H01H 85/143*** | (2006.01) |

(52) U.S. Cl.

CPC ..... *H01H 85/38* (2013.01); *H01H 69/02* (2013.01); *H01H 85/08* (2013.01); *H01H 85/143* (2013.01); *H01H 85/18* (2013.01)

(58) Field of Classification Search

CPC ..... H01H 69/02; H01H 85/08; H01H 85/143; H01H 85/18; H01H 85/38; H01H 2085/388

USPC ..... 337/273

See application file for complete search history.

(56) References Cited

U.S. PATENT DOCUMENTS

| | | | | |
|---|---|---|---|---|
| 2,882,243 A | | 4/1959 | Milton | |
| 2,882,244 A | * | 4/1959 | Milton | B01J 20/18 208/2 |
| 3,227,844 A | * | 1/1966 | Burrage | H01H 85/18 218/158 |
| 3,838,375 A | | 9/1974 | Frind et al. | |

(Continued)

FOREIGN PATENT DOCUMENTS

| | | |
|---|---|---|
| AU | 174864 B2 | 12/2001 |
| CA | 1186716 A | 5/1985 |

(Continued)

OTHER PUBLICATIONS

EPO machine translation of Shimizu JP 2011060687.*

(Continued)

*Primary Examiner* — Jacob R Crum

(74) *Attorney, Agent, or Firm* — Armstrong Teasdale LLP

(57) ABSTRACT

Power fuses having filler material including hydrated zeolite material facilitates increasing power density of electrical fuses in reduced package sizes. The hydrated zeolite material releases water to cool and suppress electrical arcing conditions experienced in higher power circuitry.

12 Claims, 13 Drawing Sheets

(56) References Cited

U.S. PATENT DOCUMENTS

| | | | | |
|---|---|---|---|---|
| 3,912,650 | A * | 10/1975 | Khalid | H01H 33/76 106/425 |
| 3,958,206 | A | 5/1976 | Klint | |
| 4,272,752 | A * | 6/1981 | Jacobs, Jr. | H01H 85/18 29/623 |
| 4,313,099 | A | 1/1982 | Ackermann | |
| 4,358,747 | A | 11/1982 | Zlupko et al. | |
| 5,270,679 | A * | 12/1993 | Gulbrandsen | H01H 85/153 29/623 |
| 6,645,637 | B2 | 11/2003 | Kaltenborn et al. | |
| 2008/0237194 | A1 | 10/2008 | Moore et al. | |
| 2008/0314070 | A1 * | 12/2008 | Maier-Laxhuber | F25B 17/08 62/480 |
| 2012/0068810 | A1 * | 3/2012 | Spalding | H01H 85/157 337/248 |

FOREIGN PATENT DOCUMENTS

| | | | |
|---|---|---|---|
| CA | 1186716 | A1 | 5/1985 |
| DE | 2932570 | A1 | 11/1980 |
| EP | 1162640 | A1 | 12/2001 |
| EP | 2658054 | A1 | 10/2013 |
| EP | 2619863 | B1 | 7/2014 |
| JP | 10125212 | A | 5/1998 |
| JP | 2003332019 | A | 11/2003 |
| JP | 2011060687 | A | 3/2011 |
| JP | 2014216308 | A | 11/2014 |
| WO | 2012038442 | A1 | 3/2012 |

OTHER PUBLICATIONS

EPO machine translation of Kuwabara JP H10125212.*

EPO machine translation of Wuethrich DE 2932570.*

International Preliminary Report of Patentability and Written Opinion for International Application No. PCT/US2015/063334, dated Jun. 15, 2017, 9 pages.

* cited by examiner

POWER FUSE AND FABRICATION METHODS WITH ENHANCED ARC MITIGATION AND THERMAL MANAGEMENT

CROSS REFERENCE TO RELATED APPLICATIONS

This application claims the benefit of U.S. Provisional Application Ser. No. 62/086,472 filed Dec. 2, 2014, the complete disclosure of which is hereby incorporated by reference in its entirety.

BACKGROUND OF THE INVENTION

The field of the invention relates generally to electrical circuit protection fuses and methods of manufacture, and more specifically to electrical circuit protection fuses and methods of manufacture to enhance electrical arc mitigation and thermal management as the fuse opens a circuit path.

Fuses are widely used as overcurrent protection devices to prevent costly damage to electrical circuits. Fuse terminals typically form an electrical connection between an electrical power source or power supply and an electrical component or a combination of components arranged in an electrical circuit. One or more fusible links or elements, or a fuse element assembly, is connected between the fuse terminals, so that when electrical current flow through the fuse exceeds a predetermined limit, the fusible elements melt and open one or more circuits through the fuse to prevent electrical component damage.

In view of constantly expanding variations of electrical power systems, known electrical fuses are disadvantaged in some aspects. In particular, industry tends to provide higher performing fuses without changing the physical package size of the fuse relative to conventional fuses, or alternatively to provide higher performing fuses in a smaller physical package size than conventional fuses, presents practical challenges to electrical fuse manufacturers. High power, high current applications are becoming more prevalent in electrical power systems and are imposing increased demands on fuse manufacturers to provide fuses capable of performing in such applications within desired package size constraints. In particular, in higher power, higher current, and/or higher voltage applications arc energy may be dramatically increased as the fuse operates relative to conventionally provided fuses. Conventional fuse constructions are not well equipped to contain the arc energy in such applications, and consequently cannot be reliably provided in certain package sizes if at all. Improvements are desired to meet the needs of the marketplace.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Exemplary embodiments of electrical fuses are described hereinbelow including enhanced electrical arcing mitigation and thermal management features to facilitate higher performing fuses in higher power, higher current and/or higher voltage applications. The enhanced electrical arcing mitigation and thermal management features facilitate increased power density in electrical fuses having about the same size as conventional fuses and/or increased power density in fuses having a smaller physical size relative to conventional fuses. The enhanced electrical arcing mitigation and thermal management features also render it possible to manufacture fuses of a certain physical size with fuse ratings that can be difficult, if not impossible, to obtain using conventional fuse fabrication techniques.

These and other benefits are made possible via enhanced fuse filler materials, sometimes referred to as arc quenching or arc suppression media or materials, described further below. Method aspects associated with the arc quenching or arc suppression materials and electrical fuses including such materials will be in part apparent and in part explicitly discussed below.

Figure 1:
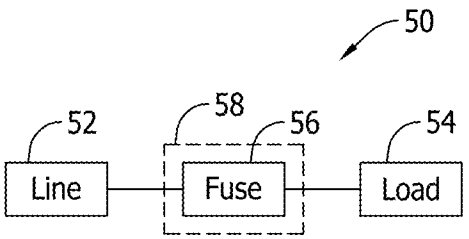
FIG. 1 is a block diagram of an exemplary electrical power system including a fuse.

FIG. 1 is a block diagram of an exemplary power system 50 including a power supply or line side circuitry 52 and power receiving or load circuitry 54 interfaced with an electrical fuse 56. The electrical fuse 56 provides overcurrent protection to the load circuitry 54. In normal operating conditions, the fuse 56 completes the circuit path and facilitates current flow between the line side circuit 52 and the load side circuit 54. As such, electrical current may flow through the fuse 56 from the line side 52 to the load side 54 when the line side circuitry 52 is energized.

In response to a predetermined current condition, however, the fuse 56 opens a circuit path through the fuse 56 and opens the connection between the line side circuitry 52 and the load side circuitry 54. That is, an open circuit is established by the fuse 56 when the fuse operates from its normal, current carrying state to its opened state that can no longer conduct current. The predetermined current condition causing the fuse 56 to open may vary from application, and may result from electrical fault conditions. In any event, once the fuse 56 operates to open the connection between the line side circuitry 52 and the load side circuitry 54, the line side circuitry 54 is electrically isolated from the line side circuitry 52 and potentially damaging current flow to the line side circuitry 54 is prevented.

The line side circuitry 52 and the load side circuitry 54 may be or may include alternating current (AC) or direct current (DC) circuits of any type. The power system 50 may be a standalone power system of any device, system or equipment, including but not limited to a vehicle power system for a vehicle. In the context of a vehicle and various electrical devices and appliances connected to the vehicle electric system, the vehicle may in various exemplary embodiments be a passenger vehicle (e.g., motorcycles, cars, trucks and buses designed for road use), a commercial vehicle (e.g., tractor trailers, mail trucks, delivery vehicles, garbage trucks and haulers, forklifts), construction vehicles (e.g., diggers, backhoes, bulldozers, loaders, and earthmoving equipment, graders, rollers, dump-trucks), vehicles of all types equipped for military use, vehicles designed for off-road use (e.g., tractors and other farm vehicles, four wheel drive vehicles, sport utility vehicles, all-terrain vehicles, dirt bikes, dune buggies, rock crawlers, sandrails, snowmobiles, golf carts), various types of marine vehicles (e.g., ships, boats, submarines, personal watercraft and other vessels), various types of aircraft (e.g., planes and helicopters), space vehicles (e.g., missiles, rockets, satellites and shuttles), recreational vehicles (e.g., RVs and camper trailers), or other modes of transporting persons or things that are propelled and/or powered by mechanical, electrical and other systems and subsystems. The fuse 56 may be associated with any system or subsystem of the vehicle, whether primary or auxiliary.

Modern vehicle design and requirements generally, but especially for electrical and so-called hybrid vehicles, are now demanding lighter weight components and size reduction to meet mileage requirements and cost reduction goals. Modern vehicle designs are also adopting power systems at higher operating voltages, and sometimes substantially higher voltages and current than conventional vehicle power systems. Such demands are becoming increasingly difficult to meet using existing fuse fabrication techniques.

The power system 50 may likewise be associated with a particular device such as an electronic device of all kinds. The line side circuitry 52 may include a battery power supply or other energy storage device or power source. In some cases, the electronic device including the power system 50 may be a portable or handheld device. Such portable or mobile electronic devices include devices such as cellular phones, smart phones, notebook or laptop computers, tablet computers, portable DVD players, audio and video media entertainment devices, electronic reader devices, portable gaming devices, portable global positioning system (GPS) devices, radio devices, digital camera devices, and video recorders, among others. Of course, non-portable electronic devices may also include the power system 50, such as, without limitation, audio/video receivers, DVD players, televisions, monitors, gaming systems, personal computers, etc.

Alternatively, the power system 50 may interface different power distribution systems such a power generation system (not shown) and a residential, business, or otherwise commercial power system. The power system 50 may likewise be an on-site industrial power system supplying power for an industrial facility such as a manufacturing plant.

Regardless of the various power systems contemplated above, the fuse 56 contemplated is a so-called power fuse and is subjected to relatively high operating voltage and/or current, collectively referred to herein as a "high power" application. Recognizing that power systems can be roughly categorized as high voltage, medium voltage and low voltage, the term "high power" does not necessarily correspond to a "high voltage" system. Instead, the term "high power" is intended as a reference to a relative increase in power relative to a conventional system for which a conventional fuse is compatible. As one non-limiting example, electrical power systems for conventional, internal combustion engine-powered vehicles operate at relatively low voltages, typically at or below about 48 VDC, while electrical power systems for recent electric-powered vehicles (electric vehicles or (EVs)) operate at much higher voltages (e.g., 200 VDC), and while state of the art EVs may operate at voltages as high as 450 VDC. Similar, and perhaps less extreme examples could also be cited, including but not necessarily limited to power systems for increasingly powerful electronic devices having an ever-expanding array of features, functionality and communication capabilities with other electronic devices and systems.

As shown in FIG. 1 in phantom, the fuse 56 may be coupled to an accessory 58 that is, in turn connected to the line and load circuitry 52, 54. The accessory may be in various embodiments, a fuse holder, a terminal block, a fuse block, a disconnect device, a charger appliance, an electronic device, a plug, a cable, a wiring harness, a connector or any other known electrical device or accessory that is provided in combination with the fuse 56 and that facilitates connection of the fuse 56 to the line side circuitry 52 and the load side circuitry 54.

Figure 2:
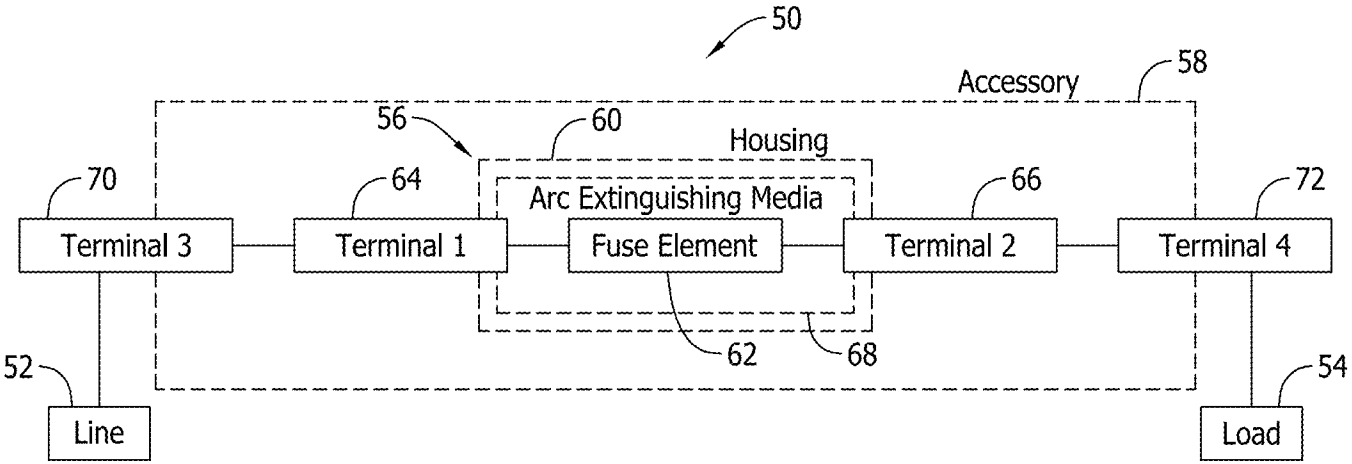
FIG. 2 is an exemplary schematic diagram of the power system shown in FIG. 1, FIG. 3 schematically illustrates an electrical arcing condition during operation of the fuse.

FIG. 2 illustrates the power system 50 in more detail, wherein the fuse 56 is seen to include a housing 60, a fuse element 62 in the housing 60 and first and second conductive terminals 64, 66 (indicated in FIG. 2 as Terminal 1 and Terminal 2) coupled to the housing 60 and electrically connected to the fuse element 62.

The fuse element 62 may be fabricated from a known conductive material using known techniques and is electrically connected to the fuse terminals 64, 66 with for example, soldered connections, welded connections, brazed connections or other known techniques. In normal operating conditions, the fuse element 62 remains intact and completes the electrical connection (i.e., provides a low resistance circuit path) between the terminal elements 64 and 66. As such, the fuse element 62 conducts current between the terminal 64 and the terminal 66 when the power system 50 is operating normally.

The fuse element 62 is normally in a current carrying state or condition that completes a circuit path between the terminals 64, 66. The fuse element 62 is, however, configured to melt, vaporize, disintegrate, or otherwise structurally fail when subjected to the predetermined electrical current condition discussed above. As the fuse element 62 opens in a high power application, electrical arcing occurs inside the housing 62. Accordingly, the housing 60 includes a filler material such as an arc extinguishing media 68 surrounding the fuse element 62. The arc extinguishing media 68 absorbs energy produced by arcing until the arc is safely extinguished. Once the fuse element 62 has opened and any arcing has subsided, the fuse 56 must be replaced with another fuse to restore the electrical connection between the line side circuitry 52 and the load side circuity 54 and resume operation of the load side circuitry 58.

As shown in FIG. 2, the accessory 58 likewise includes a pair of conductive terminals 70 and 72 (indicated in FIG. 2 as Terminal 3 and Terminal 4). The accessory terminal 70 (Terminal 3) interfaces with the fuse terminal 64 (Terminal 1) and the accessory terminal 72 (Terminal 4) interfaces with the fuse terminal 66 (Terminal 2). The accessory terminals 70 and 72 are, in turn, electrically connected to the line and load side circuitry 52 and 54 in any known manner in the art. The fuse terminals 64 and 66 may be mechanically and electrically engaged and disengaged with the accessory terminals 70, 72 with a variety of male and female terminal structures such as those described below. The terminals 64, 66 and the terminals 70, 72 may also be formed with fuse rejection features and the like as familiar to those in the art.

Many variations of fuses 56, accessories 58 and terminal structures are possible in numerous contemplated embodiments. For example, the fuse housing 60 may be a generally elongated and cylindrical tube. The housing 60 may be fabricated from any electrically insulative or nonconductive material using known techniques, including but not necessarily limited to plastic, glass, ceramic, or other suitable materials known in the art. In certain embodiments, the fuse housing 60 may be formed from a conductive material provided that the terminals 64, 66 may be electrically isolated from the fuse housing 60.

The fuse housing 60 can alternatively be fabricated into other shapes familiar to those in the art as desired. For instance, the housing 60 may be formed in a generally rectangular shape or other polygonal shape having flat sides rather than a curved outer surface having a circular cross section. Further, the fuse housing 60 may be formed as a single-piece, unitary housing, a two piece housing or a housing assembly including additional parts. For example only, the fuse housing 62 may be provided as cylindrical fuse tube when the fuse 56 is provided as a so-called cartridge fuse, a base housing piece and a cover housing piece when the fuse 56 is provided as a modular fuse such as a CUBEFuse™ power fuse module available from Bussmann by Eaton, or a base housing piece and a cap when the fuse 56 is provided as a so-called radial fuse. Various other configurations of multiple piece housings are known for various other types of fuses and applications, including but not limited to certain types of subminiature, surface mount fuses and so-called chip fuses. In some cases, the fuse housings 60 may be modular and may be configured to be touch-safe and extractable from the accessory terminals 70, 72 by hand and without tools.

The fuse element 62 may be fabricated from a conductive material having a configuration to open in response to the predetermined current condition. The fuse element 62 in some embodiments may include one or more fuse wires having a cross sectional area selected to open when exposed to the predetermined condition. The fuse wire may be wound around a former element or core as known in the art or may extend between the fuse terminals 64, 66 without any supporting element.

In other embodiments, the fuse element 62 may be fabricated as strip of conductive material having a variable cross sectional area that defines one or more weak spots, as further described below. That is, the fuse element strip 62 may be constructed with a geometry in which the location(s) of fuse element melting, and corresponding locations of electrical arcing, can be predetermined. The fuse element strip 62 may also include a treatment such as a so-called M-Effect material that affects the timing of the opening of the fuse element 62 in a known manner. Such a fuse element strip may extend as a generally flat and planar element extending between the fuse terminals 64, 66. In other embodiments, the fuse element strip may be formed or shaped with out of plane sections and may extend between the fuse terminals 62, 64 with an accordion-like zigzag shape.

In some cases, the fuse element 62 may be formed on the surface of a substrate material using known techniques such as printing or lithographic techniques.

While various fuse elements have been described, more than one fuse element 62, sometimes referred to a fusible element or fusible link, may be assembled in combination and arranged in series or in parallel in the same fuse 56. The fuse 56 may accordingly be configured as a so-called full-range fuse, a time delay fuses, a high speed fuse, or still another type of fuse having desired opening characteristics. Also, the fuse 56 may optionally include a local state indicator as desired, whereby visual inspection of the exterior of the fuse 56 can reveal whether or not the fuse 56 has opened.

Regarding the terminal structure, the fuse terminals 64, 66 may be generally cylindrical end caps or ferrules extending on opposing ends of the fuse housing 60. Such ferrules may be engaged with terminals 70 and 72 formed as resilient fuse clips that receive the ferrules. Other configurations of fuse terminals 64, 44 are possible, however.

For example, the fuse terminals 64, 66 may be or may include terminal blade contacts or knife blade contacts the may be received in terminals 70, 72 formed as resilient fuse clips. In the case of terminal blade contacts, the terminal blade contacts may extends axially on opposing ends or sides of the fuse housing 60, or may extend on a common side of the fuse housing 60. Such terminal blade contacts may further extend in a coplanar relationship, a spaced apart and parallel orientation, an offset orientation, a staggered orientation, or a perpendicular orientation. In some cases, fuses including terminal blade contacts may be configured for plug-in engagement with the accessory terminals 70, 72 by hand and without tools.

The fuse terminals 64, 66 in still other embodiments may include flexible axial leads that extend axially from opposed ends of the housing 60 or from a common side of the housing. Such axial leads may be connected to line and load side wires using known connectors, or may be mounted to a circuit board via through-hole mounting.

In still other embodiments, the fuse terminals 64, 66 may be or may include flat and planar surface mount terminations that can be surface mounted to a circuit board. The terminals may be prefabricated and assembled with the fuse housing 60 or may be formed by dipping or coating the ends of the housing 60.

Figure 3:
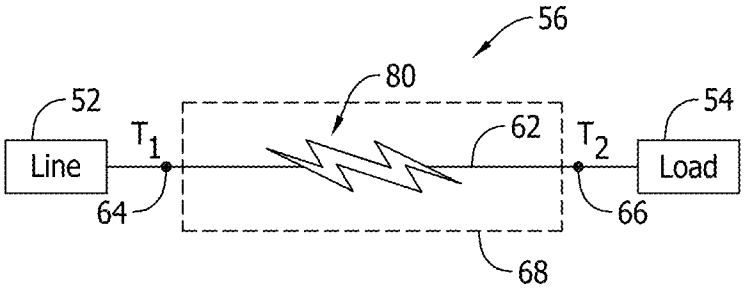

Now referring to FIG. 3, as the fuse 56 is subjected to the predetermined electrical current condition, the fuse element 62 melts open at one more locations between the fuse terminals 62, 64 but current continues to flow and forms one or more electrical arcs. Such an electric arc, or arc discharge, is an electrical breakdown of a gas that produces an ongoing plasma discharge, resulting from a current through the normally nonconductive arc quenching media 68 that surrounds the fuse element 62.

Generally speaking, as the fuse element 62 operates in higher power, higher current circuitry, increasing amounts of electrical energy exist that causes an increasing severity or intensity of electrical arcing. Operating conditions of electrical fuses in such higher power systems is much more severe, however, than lower power systems. More specifically, specifications relating to electrical arcing conditions as the fuse opens can be particularly difficult to meet for higher power systems, especially when coupled with the industry preference for reduction in the size of electrical fuses. While known power fuses are presently available for a variety of power systems operable at different voltages and currents, the size and weight, not to mention the cost, of conventional power fuses capable of meeting the requirements of increasingly higher power systems is impractically high for implementation in certain applications.

In particular, while known arc quenching media and materials exist they are disadvantaged in some aspects to increase a power density of the fuse 56 to a level needed to achieve market desires. As used herein, the term "power density" refers to fuse amperes per unit volume. The more current that can be passed through the fuse element 62 in a given fuse housing 60 that in turn defines the volume of the fuse, the greater the fuse density. Improving or increasing power density of the fuse 56 provides substantial benefits in at least three aspects.

Firstly, increasing the power density of the fuse 56 may facilitate fuses having higher ratings for high power applications than are conventionally possible in certain types of conventional fuses.

Secondly, increasing the power density of the fuse 56 achieves higher fuse ratings and performance for higher power applications while otherwise providing fuses of a comparable size to conventionally fabricated fuses having lower ratings. That is, improved fuses 56 can be provided having a similar size to existing and conventional fuses but greater, and possibly substantially greater, fuse ratings and capabilities than before.

Thirdly, increasing the power density of the fuse 56 facilitates a fuse having a smaller size than a conventional fuse having the same rating. That is, improved fuses 56 can be provided having a smaller, and possibly substantially smaller, size relative to existing fuses but having equal or greater fuse ratings than before. Of course, any reduction of size in a fuse construction provides material savings and reduces costs to manufacture higher performing fuses. In power systems including a large number of fuses 56, substantial reductions in the space necessary to implement a power system can be realized.

There is some tension, however, between the desire to increase power density of the fuse 56 and conventional fuse fabrication techniques. Historically, and for good reason, circuit protection fuses have tended to increase in size to meet the demands of higher power electrical power systems. Consequently, certain types of power fuses are relatively large and relatively heavy components. This is at least in part attributable to the necessity of containing arc energy that becomes increasingly severe in higher power circuitry relative to lower power circuitry. Larger and longer arcs, as well as arcs that are sustained for longer periods in higher power circuitry, require greater amounts of arc extinguishing media to absorb arc energy. Known arc extinguishing media is generally incapable, however, of containing increased arc energy in certain situations and thus present a practical ceiling to fuse performance using existing fabrication methods. If the arcing energy cannot be safely contained in the fuse 56, an undesirable an unacceptable rupture of the fuse housing 60 may occur.

Accordingly, and as explained below, the fuse filler or arc quenching media 68 in embodiments of the present invention is formulated to provide enhanced arcing mitigation and thermal management in the fuse 56 as it operates to more capably perform in higher power circuitry presenting increased arc severity. Higher power density relative to conventionally fabricated fuses is therefore possible. and so are increased fuse ratings and/or reduction in the physical size of the fuse 56 to meet longstanding and unresolved needs in the art.

Turning now to FIG. 3, and as previously mentioned, the electric fuse 56, and more specifically the fuse element 62, is designed to conduct normal circuit operating currents and designed to respond to predetermined abnormal overcurrent conditions by melting, in response to heat generated by the predetermined current condition, and opening to stop the flow of current through the fuse 56. During the opening process, the fuse 56 abides to a time-current calibration for the melting time of the fuse element 62, but once the melting process is complete an electric arc 80 is then ignited and this arc will now burn in response to the energy delivered by the voltage source (i.e., the line side circuitry 52 or power supply) and any energy stored in the circuit attributable to inductance and or capacitance. Once ignited, the arc 80 (or possibly arcs) burns at several thousand degrees centigrade and if not mitigated quickly can cause the fuse 56, and more specifically the fuse housing 60, to rupture and fail catastrophically.

Electric arcs 80 can operate at temperatures as high as 50,000° K under certain conditions. Extinguishing or cooling the arc 80 can be achieved by various methods and materials, including the use of filler material to absorb heat energy from the arc, arc division features to reduce arc intensity at the locations where they occur, and via generation of a gas to suppress arcing conditions. However accomplished, removal of any thermal energy generated by the arc 80 is key to improving power density of the fuse 56.

In conventional electrical fuses, a fuse filler material is conventionally employed to help cool or quench and shorten the arcing event as the fuse element opens. As fuses become smaller in size and/or higher in operating voltage or power, as increasingly desired by various users, the arc 80 becomes a greater challenge to contain safely within the fuse enclosure or housing 60.

One very common and very effective fuse filling material is quartz silica sand in a conventional fuse construction, and in particular, silica sand is used today rather extensively in most modern power type-fuses for cooling electrical arcs. Quartz silica sand filling material can in many cases thermally balance the time-current operating performance of the fuse element during the melting phase of the fuse opening process. Additionally, the quartz silica sand provides a good thermal energy absorbing medium and thermal insulating medium for cooling and quenching the electric arc during the vaporization phase of the fuse opening process. Furthermore, the inorganic nature of quartz silica sand renders it basically inert to the electric arc and vaporization process as the fuse element opens. However, the use of silica sand has well-known limitations of design for the fuse to operate safely when either size is reduced or voltage rating is increased. Quartz silica sand is accordingly incapable of improving power density of fuses beyond those already obtained.

Adding water to the fuse filler medium can assist with the thermal balancing and arc cooling aspect of the fuse opening process and provide some improvement in performance in some cases. Filler materials including inorganic salts such as aluminum sulfate ($Al_2(SO_4)_3.18H_2O$ (octadecahydrate)) and calcium sulfate ($CaSO_4.2H_2O$ (dihydrate)) have accordingly been used in conventional fuse constructions due to their affinity to hold water in a hydrate form of the molecule. Such hydrated material compounds have been utilized for cooling electrical arcs in fuses by the simple mechanism of phase transition of the water molecules that removes heat to cool an arc.

Hydrated salts such as aluminum sulfate or calcium sulfate, however, have loosely bound or hanging water molecules on the crystal structure. This is problematic for higher power conditions providing increased arc intensity and severity. Particularly, when such hydrated salts are slightly heated for example, to about 50° C., the loosely bound water of crystallization molecules begin detaching and become free water. As this occurs, since these salts are easily dissolved in water they quickly become liquefied. When used as an arc quenching fuse filling material the liquefaction of the filler will ooze and leak from the fuse enclosure during normal current operation making them an unreliable water arc quenching medium, as well as generally undesirable from the user's perspective. In many cases, the slight heating of normal use of the fuse in its ambient environment may be sufficient to liquefy the filler. This is even more so in higher power circuitry involving larger currents, as the current flow through the fuse element even in normal conditions will cause heating of the fuse element to reach elevated levels compared to conventional fuses designed for lower power applications or a lesser power density.

The water in such hydrated salt materials may nonetheless provide a good fuse filler offering an effective cooling mechanism for extinguishing the fuse arc in some circumstances wherein heating to the point of liquefaction does not occur. Controlling heat conditions in fuse operation to avoid this is generally impractical in most applications, but even in the absence of liquefaction problems may remain.

For example, hydrated salt materials in many cases will not retain all of their water during normal fuse heating and circuit current operation and as such are disadvantaged for higher power, higher current applications. During normal operation, current flow through the fuse element 62 generates heat, referred to herein as fuse heating. As fuse heating occurs, many of the loosely bound water molecules found in hydrated salts such as aluminum sulfate and calcium sulfate are released. As mentioned above, this may happen at temperatures as low as 50° C. which may easily be reached by fuse heating and/or ambient operating environments in high power, high current circuitry. If such fuse heating occurs for a sufficient period of time, the water molecules in the hydrated salts may be lost from the fuse enclosure or housing 60 and hence are no longer available for arc cooling when needed. Aluminum sulfate and calcium sulfate therefore have a limited effectiveness to increase a power density of the fuse 56 to the levels desired for general use conditions.

To address these issues, the arc extinguishing media or material 68 in the fuse housing 60 of the fuse 56 includes molecular sieve material, and more specifically hydrated Zeolite molecular sieves. Molecular sieves are materials that incorporate very small holes or pores and cavities of precise and uniform size and geometry. The size and geometry of the holes, pores and cavities will block large molecules from passing through the material while allowing the passage of smaller ones.

Zeolite molecular sieves are notable for their ability to capture organic and inorganic materials. They are commonly used as desiccants for removing moisture or as an adsorbent to capture a targeted ion or molecule. Silica gel and activated carbon are examples. They are different from other known filter mediums in that they trap or adsorb material on the molecular level. Accordingly, zeolite molecular sieves offer a superior mechanism for retaining and releasing bound water for the purpose of cooling an arc 80 within the fuse 56.

As discussed further below, the water bound to zeolite molecular sieves in the filler material 68 advantageously cools arcing in multiple different ways depending on the actual arcing energy experienced in opening of the fuse element 62. Specifically, the water may be released to directly cool the arc, and also generate steam pressure when vaporized. Added pressure via generation of steam helps to compress ionized gas and increases the arc voltage quickly and drives the fault current to zero.

If the water is not vaporized, the Zeolite molecular sieves in the filler material 68 can regain or re-adsorb the water molecules that were previously released for cooling. Unlike hydrated salt materials discussed above, if the fuse 56 is temporarily heated to a point of water release from the zeolite material, the water is not lost. That is the water does not escape but remains inside the fuse housing 60 and upon cooling of the fuse 56 the water is instead is once again bound to the zeolite material. Therefore, when the fuse 56 is sufficiently re-heated by another heating event, the bound water can be re-released from the zeolite material. Especially for fuses that are subjected to repeated heating cycles, this process of release and re-adsorption can be repeated indefinitely to constitute an active phase change cooling system for the purpose of reducing the thermal-mechanical strain or fatigue on the fuse element 62 as discussed in further detail below.

In another aspect, zeolite molecular sieves are capable of capturing and exchanging metal vapor ions during the arcing process as the fuse element opens. The capture of the metal ions also advantageously helps to reduce or deionize the metal vapor gas or plasma and effectively neutralize the arc potential.

Zeolite molecular sieves, referred to herein as zeolites, exist in both natural and synthesized forms. Either natural or synthetic zeolites may be used in different embodiments of the fuse 56 as the filler material 68. In the natural form, Zeolites are microporous naturally occurring minerals that have an affinity for adsorption of ions in both liquids and gases, typically formed during volcanic activity. Natural zeolites are found in many different molecular configurations, but only in very specific geological areas where early volcanic processes have taken place. Natural zeolites are, however, prone to one drawback in that they often are contaminated with other elements or minerals of undesirable properties for the arc quenching filler media application presently contemplated in the fuse 56. Natural zeolites may be perhaps processed, however, to purify them or otherwise remove undesirable constituents if needed.

Exemplary natural zeolites that may be used in embodiments of the present invention include, but are not necessarily limited to the following zeolites identified by below by name and general formula:

| | |
|---|---|
| $Na_{16}[Al_{16}Si_{32}O_{96}].16(H_2O)$; | Analcime |
| $(Ca_{0.5},Na,K)_4[Al_4Si_8O_{24}].12(H_2O)$; | Chabazite |
| $(Na,K)_6[Al_6Si_{30}O_{72}].20(H_2O)$; | Clinoptilolite |
| $K_2(Na,Ca_{0.5})_8[Al_{10}Si_{26}O_{72}].28(H_2O)$; | Erionite |
| $(Na_2,Ca,Mg)_{3.5}[Al_7Si1_7O_{48}].32(H_2O)$; | Faujasite |
| $(Na,K)Ca_4[Al_9Si_{27}O_{72}].24(H_2O)$; | Heulandite |
| $Ca_4[Al_8Si1_6O_{48}].18(H_2O))$; | Laumontite |

| | |
|---|---|
| $(Na_{16}Ca_{16}[Al_{48}Si_{72}O2_{40}].64(H_2O)$; | Mesolite |
| $Ca_8[Al_{16}Si_{24}O_{80}].24(H_2O)$; and | Scolecite |
| $NaCa_4[Al_9Si_{27}O_{72}].30(H_2O)$. | Stilbite |

For fuse filler arc quenching mediums 68, inorganic zeolite species are perhaps preferred because the carbon content of organic zeolites may contribute to an arc ionization potential. By avoiding this, inorganic zeolite species may more effectively and efficiently contribute to the suppression of the arc. The synthesis of zeolites is also perhaps preferable because the composition can be precisely controlled as well as the granular size and shape to achieve optimal properties.

Synthetic zeolites may be manufactured in contemplated examples by hydrothermal synthesis from raw materials such as sodium silicate, sodium aluminate, alumina trihydrate and sodium hydroxide. Synthetic zeolites may be manufactured by various processes employing, for example, either hydrothermal synthesis or sol-gel synthesis techniques.

There are presently hundreds of synthetic zeolites that are built upon a common aluminosilicate "framework" that accommodate various cations of Na+, K+, Ca2+, Mg2+ and others that can be readily exchanged for other positive ions types (ionic exchange) and are thus well suited for arc suppression purposes in higher power conditions as the fuse element 62 opens. For example, known synthetic zeolites include, but are not limited to the following:

| | |
|---|---|
| $(Na_{0.92}K_{0.62}(TEA)_{7.6}[Al_{4.53}Si5_{9.47}O_{128}])$; | Beta |
| $((Na_{12}[(AlO_2)_{12}(SiO_2)_{12}]:27H_2O)$; | Linde Type A |
| $((NaAlO_2)_7(SiO_2)_9)$; | Zeolite P |
| $((K_{10}(Al_{10}Si_{10}O_{40}).wH_2O(w\sim8))$; | Linde Type F |
| $(K_9[Al_9Si_{27}O_{72}]:wH_2O$ (w =0 to 36)); | Linde Type L |
| $(K_{11}Al_{11}Si_{21}O_{64}.20H_2O)$; | Linde Type W |
| $(Na_{86}Al_{86}Si_{106}O_{384}:wH_2O(w\sim260))$; | Linde Types X |
| $((Na_{56}[Al_{56}Si_{136}O_{384}]:250H_2O)$; | Linde Types Y |
| $(Si_{96}O_{192}F_4(TPA)_4)$; | Silicalite-l |
| $([Si_{64}O_{128}])$; and | SSZ-23 |
| $(Na_7[Al_{17}Si_{89}O_{192}]:wH_2O)$. | ZSM-5 |

Figure 4:
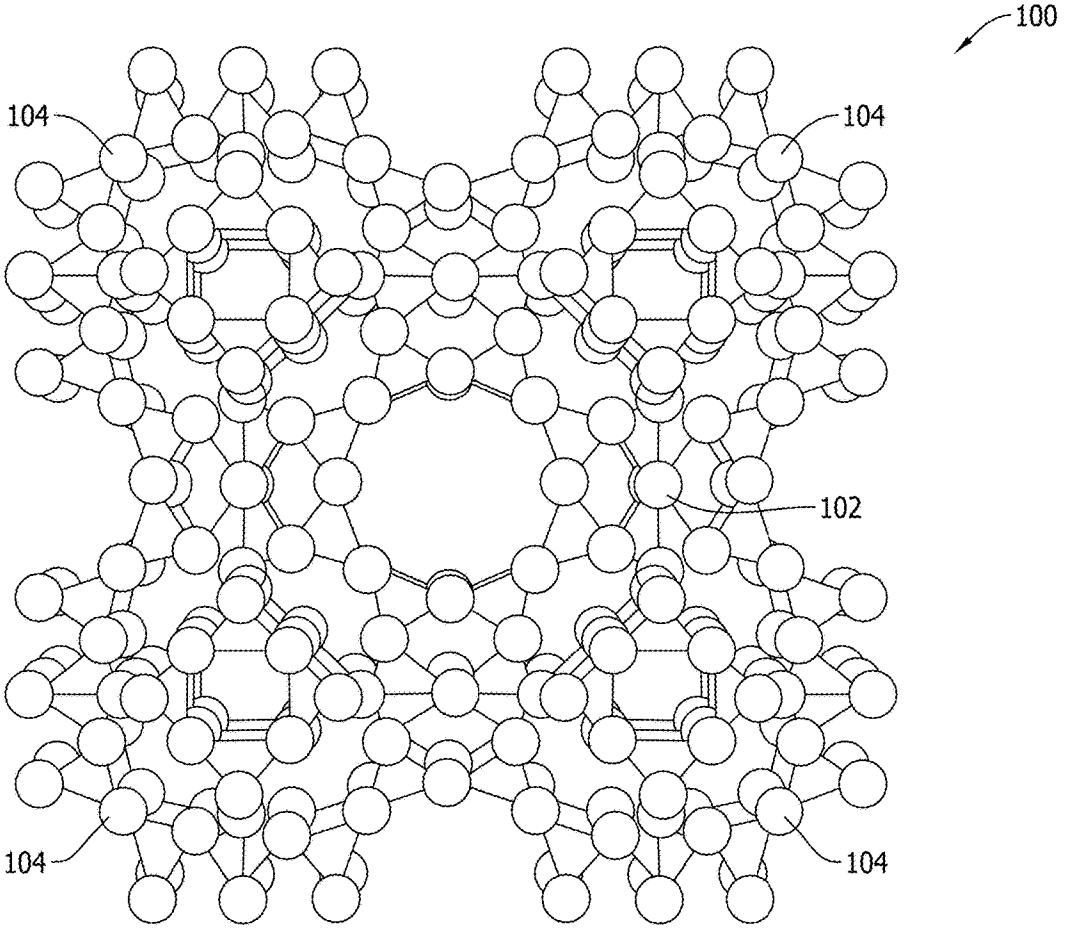
FIG. 4 illustrates a crystalline structure of a zeolite ingredient of a filler material for the fuse shown in FIGS. 1-3.

Zeolites that exhibit a crystalline-aluminosilicate-microporous structure such as that indicated with reference numeral 100 in the example of FIG. 4 are advantageous in mitigating and cooling electrical arcing with more effective thermal properties than conventional fuse filler materials. They are typically porous oxide structures that have a very high degree of crystallinity of unique molecular dimensions. Aluminosilicates are minerals composed of the metal oxides of aluminum and silicone with 4 oxygen anions that form their unique tetrahedron shape of a metal cation 102 at the center and four oxygen atoms 104 at the apexes as shown in the example illustrated. The structure illustrated in the example shown is sometimes referred to as a Linde Type A LTA structure, which can be combined with other structures in a Linde Type A LTA framework structure.

Aluminosilicates further have a unique microporous crystalline structure composed of aluminum, silicone and oxygen plus counter cations (Na+, K+, Ca2+, Mg2+). These porous structures form molecular or ionic traps that retain water molecules very well and at high temperatures. The Al/Si/O framework structure is not water soluble and remains solid during the hydration and dehydration cycle making Zeolites an ideal water storage and delivery system for a fuse filler arc quenching medium 68. Unlike the hydrated salt filler materials described above, the filler material 68 that includes zeolite will not liquefy during normal fuse heating.

Regarding their water affinity, zeolites are known that may retain 55% water by weight and also retain the water at very high temperatures, rendering them uniquely suitable as an arc cooling mechanism. Zeolite may perhaps be synthesized to become even more heavily hydrated than this, to provide even more retained water that, when liberated during arcing conditions, provides direct cooling. In some embodiments, for certain ranges of higher power operation or power density desired, the zeolite is preferably hydrated as much as possible to provide a maximum cooling effect when electrical arcing occurs as the fuse element 62 opens.

In contemplated embodiments, the retained water can be utilized for both heat energy absorption in the liquid phase and pressure generation in the vapor stage. The simple phase change of water to steam vapor or the heat of vaporization of 40.7 kJ/mol can provide a significant amount of cooling. Likewise the pressure increase from the expansion of the steam water vapor provides yet another arc extinguishing function. This combined effect can occur simultaneously or in stages depending on the amount of hydration obtained and the actual arc energy as it occurs.

In certain contemplated embodiments, and recognizing that the cooling effects of the filler material 68 may be tailored to an expected amount of arc energy when the fuse opens, the Zeolite molecular sieves may be hydrated in an amount, or adjusted in hydration to an amount, to achieve and maintain specific melting time-current characteristics of the fuse element 62 when surrounded with the filler material 68 including the zeolite molecular sieves. The amount of hydration obtained may be targeted to a predetermined amount for the purpose of deionizing the arc by direct cooling of the gas plasma.

Given any particular zeolite proposed, the amount of hydration may be supplemented or diminished by adding more water to be adsorbed or by carefully controlled heating to release a desired amount of water while retaining a targeted amount of hydration. To the extent that two or more different zeolite materials can be hydrated to different amounts, the filler material can include the differently hydrated zeolites in a desired proportion to provide sufficient water release overall that may not possible using a single zeolite alone.

The amount of hydration may also be selected or determined, including augmented hydration of the Zeolites molecular sieves for the purpose of generating internal water vapor pressure to deionize the arc by reducing the charged particle mobility and increasing the arc voltage.

Finally, the amount of hydration may also be selected or determined, including augmented hydration of the Zeolites molecular sieves for the purpose of creating an active cooling mechanism to reduce the thermal-mechanical strain (fatigue) on the fuse element and thus increase the life expectancy of the fuse when exposed to repeated loading current cycling events.

The amount of hydration in the zeolite material may be selected to achieve one of the above purposes or combinations of these purposes. In different cases depending on the severity of arcing and how long it is sustained, all of the purposes may be realized while in other cases less than all of them may be realized. Different formulations of filler materials including zeolites hydrated in different amounts may be provided for specific use in different ranges (e.g., operating voltage or current) of higher power conditions.

In further contemplated embodiments, for fuse filler mediums such as the arc extinguishing media 68 including the zeolite, the zeolite may be applied in 100% concentrations or in reduced concentration when combined with another material, including but not necessarily limited to quartz silica sand. Substituting or mixing quartz sand filler with zeolites would provide desirable dual effects of quenching the arc that each material provides. Relative proportions of zeolite and silica sand (or another material) may be provided with different degrees of effectiveness. Hydrated zeolites may also be utilized in combination with binding agents such as sodium silicate in contemplated embodiments.

More specifically, in contemplated embodiments, zeolites and zeolite-quartz sand mixtures can be mechanically bound with a sodium silicate binding solution to increase the thermal conductivity between the individual grains or particles and the fuse element 62 and other fuse components such as the fuse element 62 and terminals 64, 66. Using a water soluble binding agent such as sodium silicate also provides a hydration process for the zeolite during the same mechanical binding operation. The mechanical binding process with sodium silicate is sometimes referred to as stoning.

The introduction of zeolite molecular sieves in the arc extinguishing media 68 helps to solve the water detainment problem of conventional hydrated filler materials due to their unique aluminosilicate crystal structure or framework. By design and composition the zeolite behaves somewhat like quartz silica sand due to its high melting temperature and inorganic nature.

All aluminosilicate zeolites have the same basic empirical formulation:

$$M_{21}O.[Al_2O_3 .xSiO_2 ].yH_2O$$

where M is any alkali or alkaline earth metal, n is the degree of oxidation of the metal, wherein x is a variable number typically ranging from 2 to 10, and y is a number typically ranging from 2 to 7. Zeolites falling outside these ranges are possible, however. for example, in Clinoptilolite, the most common natural zeolite also listed above, the empirical and unit-cell formula is:

$$(Na,K)_6.[Al_6Si_{30}O_{72}].20(H_2O).$$

Zeolites have a strong affinity for water. Some zeolites can adsorb water in an amount up to 55% by weight. This is due to the attraction of the cation of the earth metal (Na+, $K^+$, $Ca2^+$ or $Mg^{2+}$) and the polar water molecule, one end-side is slightly negative and the other end-side slightly positive. The cations are not part of permanent zeolite framework, however, and under the right conditions can be exchanged for other cations.

Figure 5:
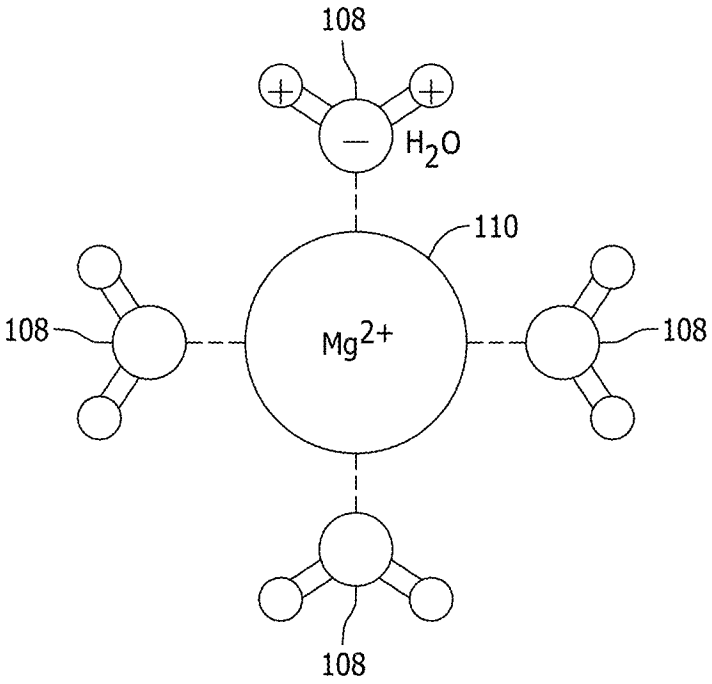
FIG. 5 illustrates water molecules interacting with a metal cation in a portion of an exemplary filler material for the fuse shown in FIGS. 1-3.
Figure 6:
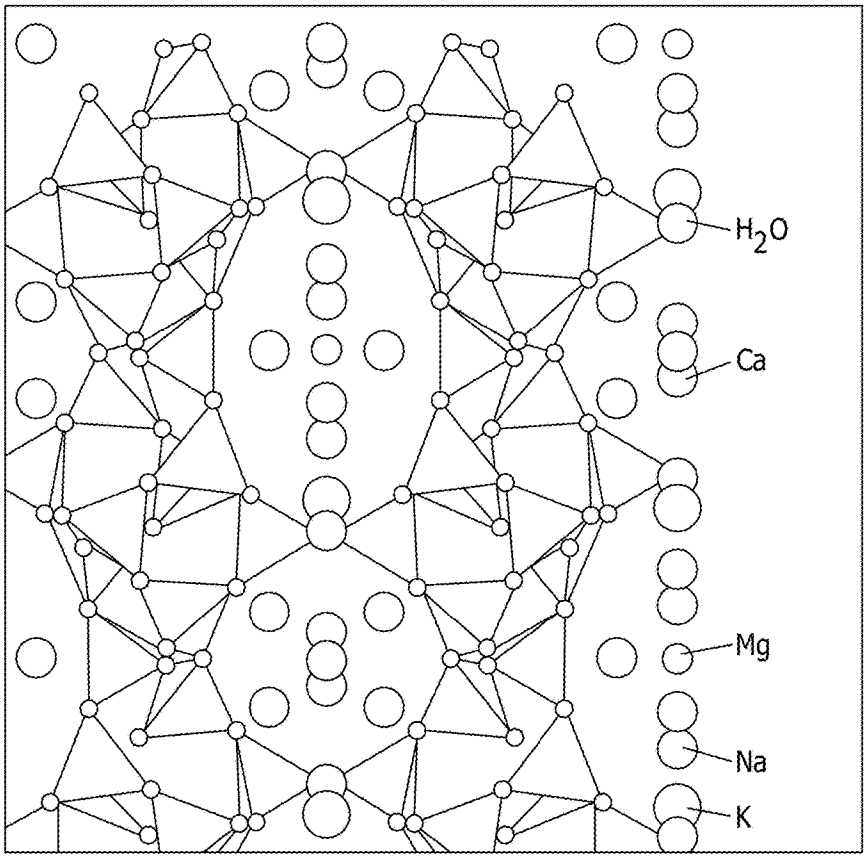
FIG. 6 illustrates a filler material structure including the water molecules interacting with a metal cation shown in FIG. 5.

As shown in FIG. 5, four water molecules interacting with a magnesium cation 110 are illustrated. The negative ends of the water dipoles are directed toward the positively charged magnesium ion. Here the dashed lines do not represent hydrogen bonds. This type of interaction is called a dipole-charge or ion-dipole interaction. The interaction shown in FIG. 5 is repeated in the structure shown in FIG. 6, that corresponds to Clinoptilolite zeolite material in a hydrated form.

Figure 7:
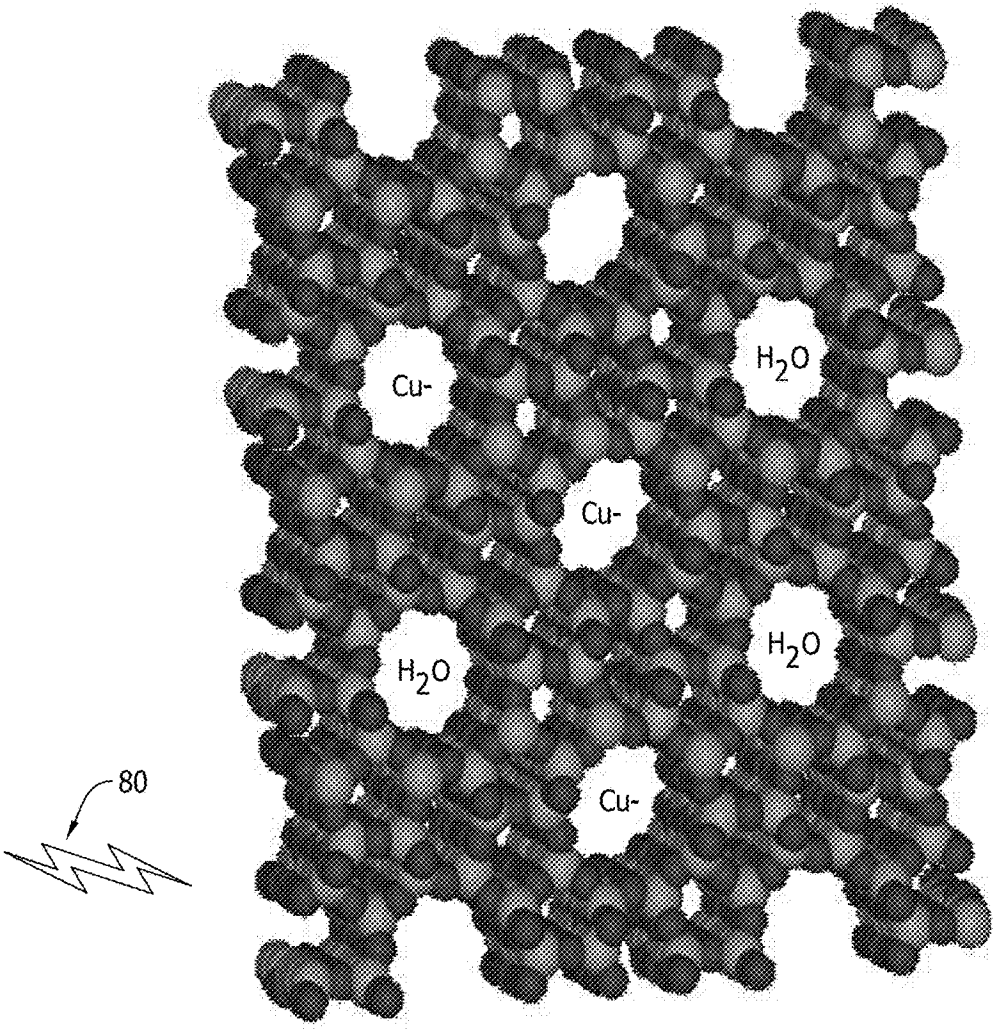
FIG. 7 illustrates a crystalline structure of a zeolite ingredient of a filler material providing an ion exchange and ion capture function in an electrical arc condition.

Additionally, and referring now to the example of FIG. 7, the zeolite molecular sieves in the filler material may provide an ion exchange and ion capture function where during the fuse element vaporization phase some of the metal ions (e.g. copper ions indicated as $Cu^-$) can be captured to assist with cooling the arc 80 by deionizing the arc plasma gas. Zeolites can be designed to facilitate a particular ion capture or ion exchange, this may be beneficial to neutralizing the arc. In some embodiments, the zeolite can be designed and synthesized to adsorb copper ions and reduce an arc column conductivity in the arc 80. As also seen in FIG. 7, water is being released from the zeolite while the ion exchange occurs. Metal vapor plasma cooling is another benefit of water cooling where fast cooling of the vaporized metal fuse element reduces the convective flow of metal ions in the arc column. The particular zeolite structure illustrated in FIG. 7 corresponds to that of synthetic zeolite ZSM-5 listed above.

By introducing better arc mitigating filler materials 68 including zeolites as described above, one can design fuses of smaller dimensions and or of higher voltage ratings. Also, it is believed that filler materials including zeolite such as those described above can be provided at lower cost than other materials having comparable capability.

Figure 8:
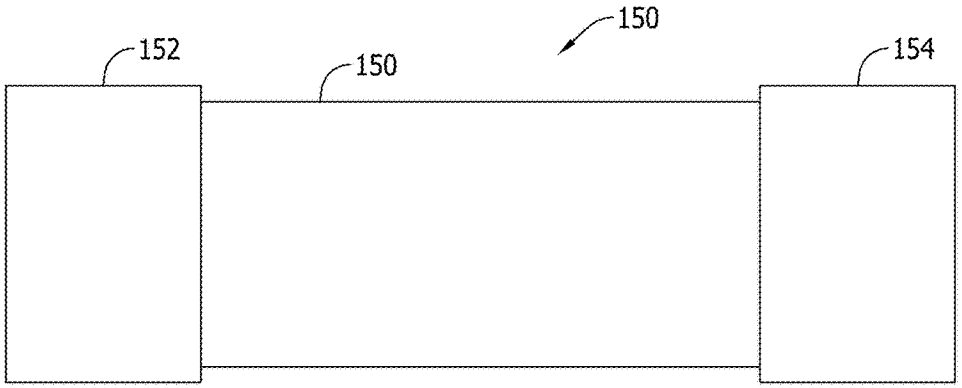
FIG. 8 illustrates a side elevation view of an exemplary fuse formed in accordance with an embodiment of the present invention.
Figure 9:
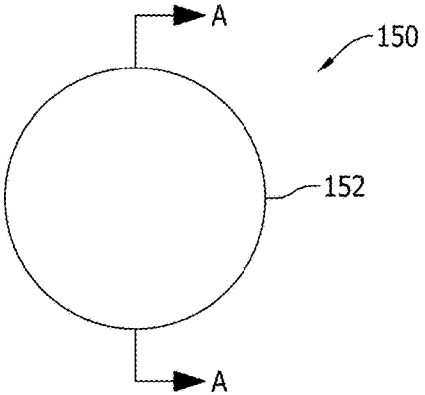
FIG. 9 is an end view of the fuse shown in FIG. 8.
Figure 10:
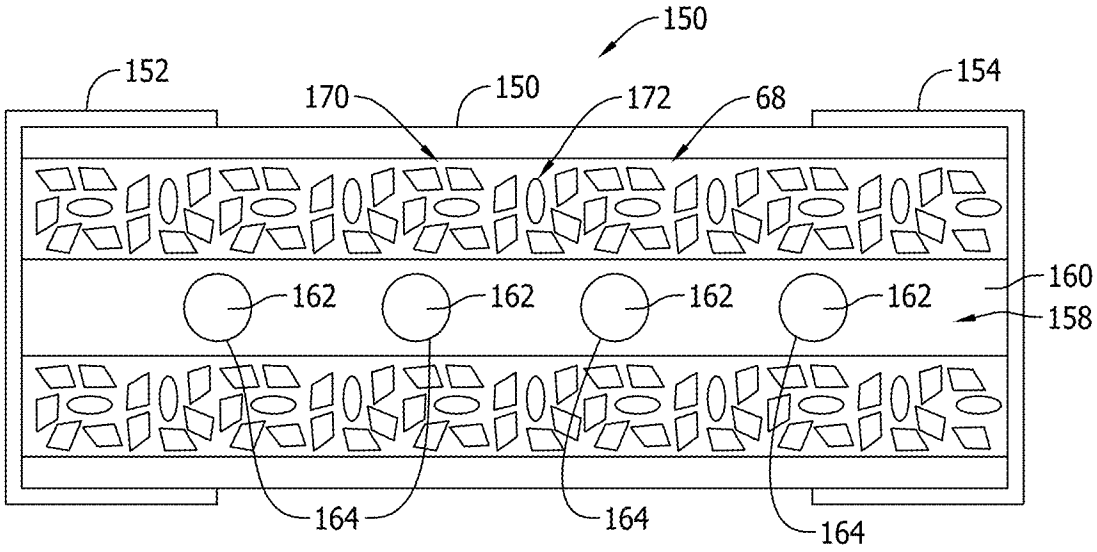
FIG. 10 is a sectional view of the fuse shown in FIG. 8 along the line A-A in FIG. 9.

FIG. 8-10 illustrates various views of exemplary fuse 150 formed in accordance with an embodiment of the present invention. The fuse includes a housing 150 formed as a generally elongated and cylindrical fuse tube having a generally circular cross section and round outer surface. Conductive end caps or ferrules 152, 154 are coupled to each opposing end of the fuse tube, and as seen in FIG. 10 a fuse element 158 extends between and completes an electrical connection between the ferrule terminal elements 152, 154.

In the example shown, the fuse element 158 is formed as a planar strip 160 of conductive metal. The fuse element strip 160 is further formed with a number of spaced-apart apertures 162 that each, in turn, define areas of reduced cross-sectional area, referred to in the art as weak spots 164. The weak spots 164 correspond to the thinnest portion of the fuse element strip 160 between adjacent apertures 162. The reduced cross-sectional areas at the weak spots 164 will experience heat concentration as current flows through the fuse element 158 and the cross-sectional area of the weak spots 164 is strategically selected to cause the fuse element 158 to open at one or more of the locations of the weak spots 164 if specified electrical current conditions are experienced.

The plurality of the apertures 162 and the plurality of weak spots 164 provided in the fuse element strip 160 facilitates arc division as the fuse element 158 operates and opens in response to a predetermined current condition. In the illustrated example, the fuse element 158 may simultaneously open at each of the four weak spots 164. The arc potential at each locations is divided by the number of weak spots 164. The arc division allows a reduced amount of filler material 68, as well as a reduction in the radius of the housing 150 so that the size of the fuse 150 can be reduced. The increased arc cooling of the filler material 68 including a combination of zeolite 170 and quartz sand 172 as described above provides further possibilities for even further reduction in the radius of the fuse housing 150.

Figure 11:
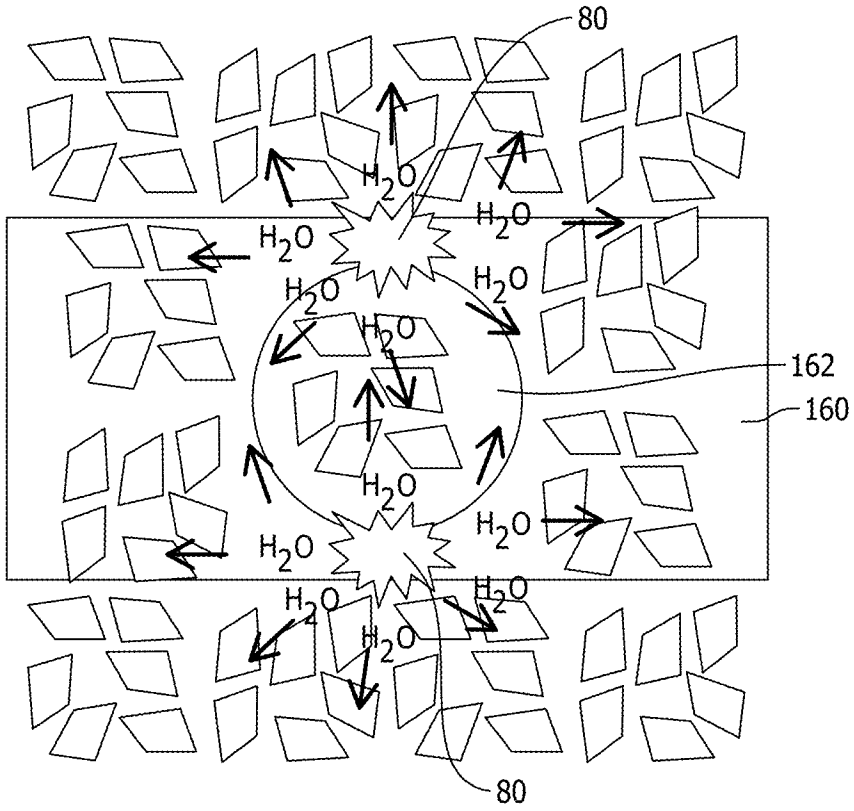
FIG. 11 shows a portion of the fuse shown in FIG. 9 in a first stage of operation.

FIG. 11 shows a portion of the fuse element 160 in a first stage of operation. In the stage shown, arcs 80 are ignited at the weak spots 164 when the fuse element is subjected to the predetermined current condition and the fuse element is in the process of opening at the locations of the weak spots 164. Water is seen to be released from the zeolite material closest to the weak spots that are heated by the ignited arcs 80. The released water begins to cool the arcs 80. Zeolite material farther away from the weak spots 164 have still retained their water and as those particles are heated to the point of release, depending on the actual intensity of the arcs 80, additional water will be released to further cool the arcs 80. As the released water is heated by the arc, it begins to be converted to steam vapor and cooling of the arc occurs due to phase transition. At the same time, zeolites not directly in the arc will also liberate their liquid water due to heating, some may vaporize, some may condense outside of the zeolite, all of which will provide further absorption of heat energy.

Figure 12:
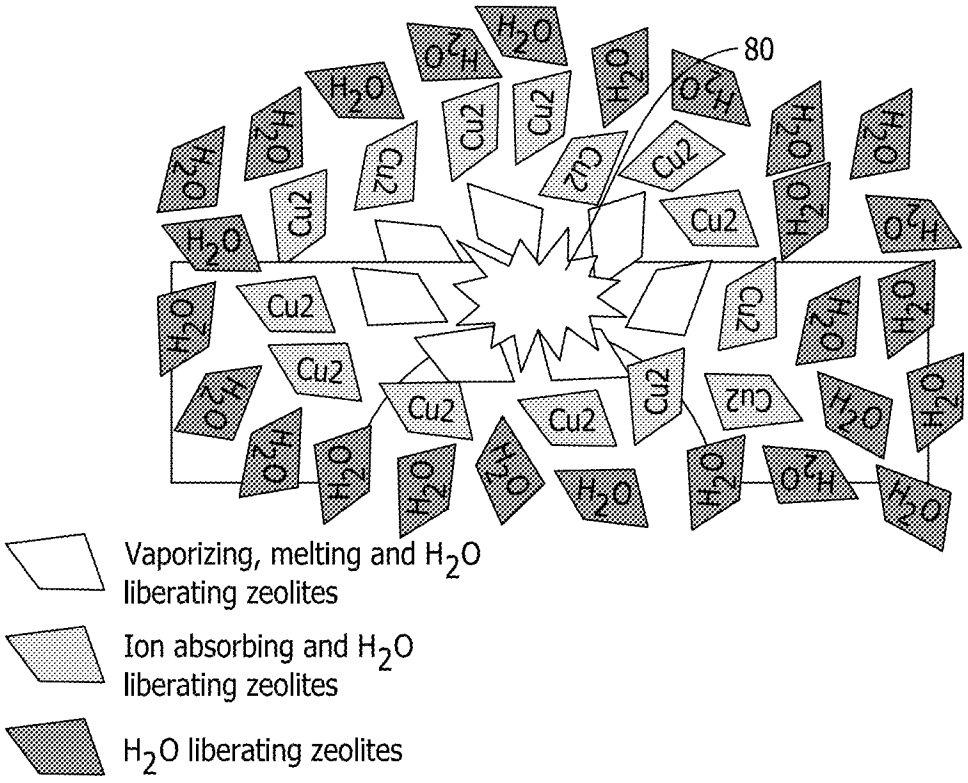
FIG. 12 shows a portion of the fuse shown in FIG. 9 in a second stage of operation.

FIG. 12 shows a portion of the fuse element 160 in a second stage of operation wherein the arc 80 continues to burn and generates even more heat in the filler material 68. The released water closest to the weak spots is now turning to steam and further heat is being removed, while pressure is increasing to de-ionize the arcs 80 at each weak spot 164. When the zeolite water of hydration is vaporized, the pressure within the fuse increases, and the density of the gases within the arc column increases as well. For example, the vaporization of the bound water will expand about 1700 times and significantly pressurize the fuse enclosure as a result. This increase of pressure, along with the decrease of arc temperature, are each crucial to deionize the gas plasma in the arc.

Specifically, the increase in gas pressure means that the gas particles in the arc 80 become closer together allowing the mean free path of these particles to be reduced as well. This reduced path increases the rate of collision between charged particles such that their mobility is reduced and the voltage to maintain the arc is increased. This increase in arc voltage is necessary to drive the current to zero (arc extinction).

As also seen in FIG. 12, metal ions from the opened fuse element 158 are being adsorbed in the zeolite material The greater the density of charged particles the higher the number of recombining of oppositely charged particles allowing a greater rate of deionization of the gas in the arc plasma.

On this note, the natural zeolite Clinoptilolite has been used for heavy metals wastewater treatment for removal of Cu, Pb and Zn from aqueous solutions by way of ion exchange with the zeolite cations (Na+, K+, Ca2+, Mg2+). In the fuse operation arcing context here described, the arc plasma gas is analogous to the aqueous solution. Let us assume a copper fuse element is being vaporized in the arc plasma. Copper cations ($Cu^{2+}$) are now present in the gas plasma and being dispersed throughout the zeolite structure. Some zeolites are being vaporized in the arc plasma releasing their cooling water and some are melting where the Al/Si framework is absorbing significant heat energy. The zeolites outside of the arc column are also releasing their water adding to the cooling effect. Additionally, these outside zeolites are adsorbing and exchanging copper cations with the zeolite cations. This adsorption of copper ions from the outer arc plasma gas column further reduces the thermal ionization of the gas.

Figure 13:
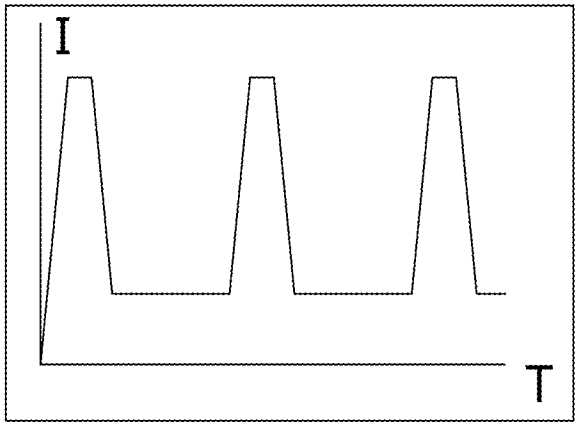
FIG. 13 illustrates an exemplary current loading for the fuse shown in FIG. 8.
Figure 14:
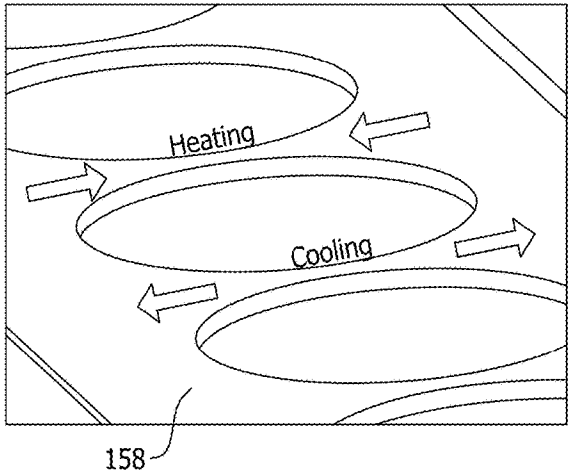
FIG. 14 illustrates a heating and cooling effect on a portion of the fuse shown in FIG. 8.

FIG. 13 illustrates an exemplary current loading cycle for the fuse shown in FIG. 8 including the fuse element 158 shown in FIGS. 10-12. The current is seen to cycle between greater and lesser amounts. Because fuse heating varies with the current, this means that the fuse element 158 undergoes a corresponding heating cycle and fluctuates between higher and lower temperatures. As illustrated in FIG. 14, this creates a propagating thermal wave in the fuse element 158 wherein different portions of fuse element 158 are being heated and cooled at different times and at different rates as the current cycle continues. In conventional fuses this can undesirably result in thermal strain at the weak spots in the fuse element that can impair reliable operation of the fuse.

Fuse element fatigue is an accumulative thermal-mechanical strain effect focused directly on the element weak-spots due to load current cycling operation. The amount of strain imposed on a weak-spot is directly propositional to the magnitude of temperature swing during any current pulse event. Because the filler material 68 including the zeolite operates as an active cooling system as described above, the effects of the thermal strain that may otherwise occur can be effectively managed even as the current increases and subjects the fuse element to greater amounts of heat in use. Active thermal management provided by the zeolites in the material can be used to cool the fuse element during a current pulse event and thus reduce the temperature swing and corresponding strain.

Figure 15:
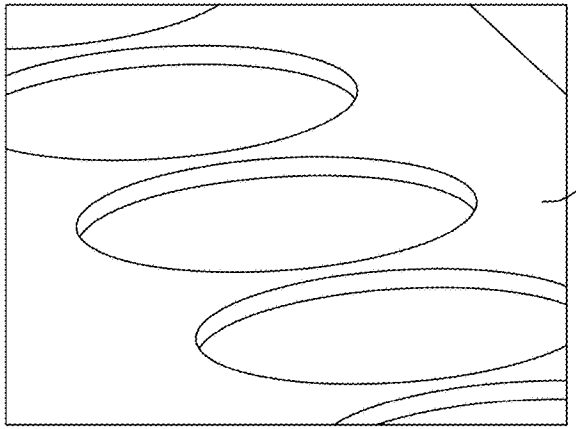
FIG. 15 illustrates a thermal strain effect on a portion of the fuse shown in FIG. 14.

Zeolites and their water adsorption property can be used for active cooling of the fuse element during load current heating cycles and avoid the issues discussed in relation to FIGS. 13-15. During a current cycle the fuse element heats with the highest temperatures at the weak-spots. Zeolites present about the weak-spot become heated and release their water. This water can now provide cooling of the weak-spot and thus reduce the thermal-mechanical strain magnitude. Upon cooling the zeolite will re-adsorb the release water and have it ready for the next heating cycle.

Figure 16:
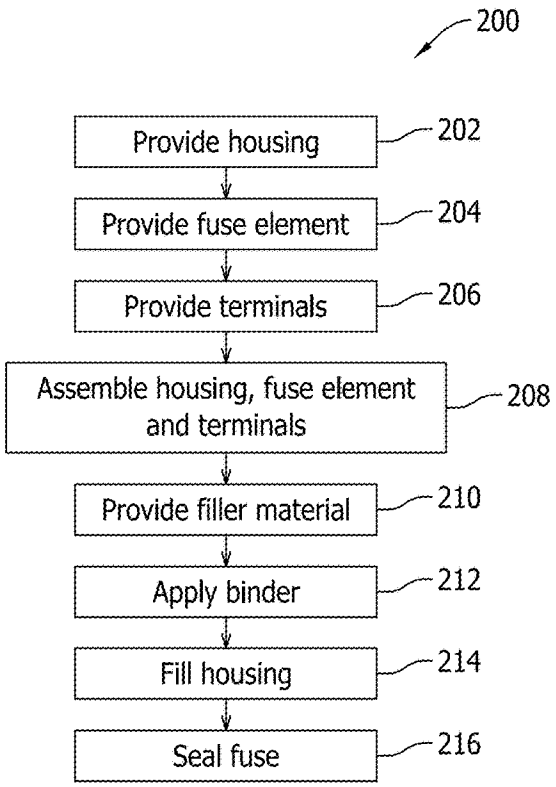
FIG. 16 illustrates a flowchart of an exemplary method of manufacturing fuses according to the present invention.

FIG. 16 illustrates a flowchart of an exemplary method 200 of manufacturing the fuse 56 or 150 described above.

The method includes providing the housing at step 202. The housing provided may correspond to any of the housings described above.

At step 204, at least one fuse element is provided. The at least one fuse element may include any of the fuse element or fuse element assemblies described above.

At step 206, fuse terminals are provided. The fuse terminals may correspond to any of the terminal structures described above.

At step 208, the components provided at steps 202, 204 and 206 may be assembled partially or completely as a preparatory step to the remainder of the method 200.

At step 210, a filler material is provided. The filler material may be the filler material 68 described above, and accordingly may include one or more zeolites only, or a combination of zeolite material and a quartz sand material or other material as described above. Step 210 as contemplated may include a synthesis of zeolite. As described above, the zeolite type and particulate size can be varied for control of how much water volume is present in the completed fuse and in particular about the fuse element at locations where arcing will commence during fuse interruption. Step 210 as contemplated also includes method steps of hydrating, adjusting, or altering an amount of adsorbed water to obtain a zeolite material that is hydrated to a targeted amount or degree.

At step 212, a silicate binder is applied to the filler material provided at step 210. In one example, the silicate binder may added to the filler material as a sodium silicate liquid solution. Optionally, the silicate material may be dried to remove moisture, and may then be provided for purposes of step 210.

At step 214, the housing may be filled with the silicate filler material provided at step 212 and loosely compacted in the housing around the fuse element. An opening may be provided in the housing, or in another external component of the fuse so that the filler material can be introduced to the housing. Optionally, the filler is dried after filling to solidify the silicate and create a bond between the filler material and portions of the fuse element. In some embodiments, a sodium silicate liquid solution may be added after the fuse is filled with the filler media and dried to create a bond between the filler material and portions of the fuse element.

The fuse is sealed at step 216 to complete the assembly.

It is understood that the method 200 shown is exemplary only and is non-limiting. Certain steps as shown may be considered optional in some embodiments and other steps may be included. The method, steps and processes described may be combined with other methods, steps and processes to achieve some, if not all, of the benefits and advantages of the inventive concepts described herein.

In summary, the molecular structure of zeolite has a great affinity for attracting and holding water molecules tightly within their unique crystal framework. Unlike aluminum sulfate and calcium sulfate filler materials, the trapped water of zeolite is only released at much higher temperatures than that of inorganic salts and upon release the zeolite crystal structure does not liquefy. Additionally, the released water from the zeolite can be re-adsorbed upon cooling and again be available when needed. This ability of the zeolite to release water upon heating and then re-adsorb the same water upon cooling can provide an active phase cooling mechanism for the fuse to utilize during temporary high thermal events from transient overcurrent events. Reducing the thermal mechanical fatigue strain on the fuse element system during transient current events is one benefit of this active cooling mechanism.

The benefits and advantages of the inventive concepts discloses are now believed to have been amply illustrated in relation to the exemplary embodiments disclosed.

An embodiment of a power fuse has been disclosed including a housing, first and second conductive terminals coupled to the housing, and a conductive fuse element in the housing and electrically connected to the first and second conductive terminals. The conductive fuse element is constructed to structurally fail when subjected to a predetermined electrical current condition in an electrical power system, and an arc extinguishing filler surrounds the conductive fuse element in the housing. The arc extinguishing filler material includes a molecular sieve material that is hydrated in a targeted amount, or adjusted in hydration to a targeted amount, to achieve and maintain a predetermined melting time-current characteristic of the conductive fuse element in response to the predetermined electrical current condition.

Optionally, the molecular sieve material may include hydrated zeolite material. The arc extinguishing filler material may be 100% hydrated zeolite. Alternatively, the arc extinguishing filler material may include quartz silica sand. The arc extinguishing filler material may also include a binding agent. The binding agent may be sodium silicate.

As further options, the molecular sieve material may include a natural molecular sieve material. The natural molecular sieve material may be an inorganic zeolite material.

The molecular sieve material optionally may also include a synthetic molecular sieve material. The synthetic molecular sieve material may exhibit a crystalline-aluminosilicate-microporous structure.

Optionally, the molecular sieve material comprises two or more different zeolite materials. The molecular sieve material may include Clinoptilolite. The conductive fuse element may also be constructed to facilitate arc division as the fuse element structurally fails when subjected to the predetermined electrical current condition.

An embodiment of a power fuse has also been disclosed including a housing, first and second conductive terminals coupled to the housing, and a conductive fuse element in the housing and connected between the first and second conductive terminals. The fuse element is constructed to facilitate arc division as the fuse element opens in a predetermined overcurrent condition, and an arc extinguishing filler surrounding the fuse element in the housing. The arc extinguishing filler material includes at least one zeolite material that is hydrated in a targeted amount, or adjusted in hydration to a targeted amount, to achieve and maintain a predetermined melting time-current characteristic of the conductive fuse element in response to the predetermined electrical current condition.

Optionally, the arc extinguishing filler further may include quartz silica sand. The arc extinguishing filler further may also include sodium silicate. The at least one zeolite material may include a first zeolite material and a second zeolite material different from the first zeolite material. The at least one zeolite material may be Clinoptilolite.

A method of making an electrical power fuse including a conductive fuse element extending internal to a housing between first and second conductive terminals has also been disclosed. The method includes: surrounding the fuse element in the housing with an arc extinguishing filler material including at least one zeolite material that is hydrated in a targeted amount, or adjusted in hydration to a targeted amount, to achieve and maintain a predetermined melting time-current characteristic of the conductive fuse element in response to the predetermined electrical current condition.

Optionally, the method may include mixing the at least one zeolite material with quartz sand.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A power fuse comprising:

a housing;

first and second conductive terminals coupled to the housing;

a conductive fuse element in the housing and electrically connected to the first and second conductive terminals, the conductive fuse element being a planar strip of conductive metal that is responsive to a predetermined electrical current condition in an electrical power system to open a circuit between the first and second terminals, and the conductive fuse element facilitating arc division as the conductive fuse element structurally fails to open the circuit; and an active cooling mechanism in the form of a filler material surrounding the conductive fuse element in the housing and being formulated to cool the conductive fuse element and reduce thermal-mechanical strain on the conductive fuse element in repeated load current cycling events that are insufficient to cause the conductive fuse element to fail and open a circuit connected through the first and second conductive terminals, thereby increasing the life expectancy of the power fuse;

wherein the filler material of the active cooling mechanism comprises a molecular sieve material that is hydrated in a selected amount to actively cool the conductive fuse element in the repeated load current cycling events while otherwise maintaining a predetermined melting time-current characteristic of the conductive fuse element in response to the predetermined electrical current condition;

wherein the filler material is 100% molecular sieve material that is hydrated in the selected amount.

2. The power fuse of claim 1, wherein the molecular sieve material comprises a zeolite material.

3. The power fuse of claim 1, wherein the molecular sieve material comprises a natural molecular sieve material.

4. The power fuse of claim 3, wherein the natural molecular sieve material is an inorganic zeolite material.

5. The power fuse of claim 1, wherein the molecular sieve material comprises a synthetic molecular sieve material.

6. The power fuse of claim 5, wherein the synthetic molecular sieve material exhibits a crystalline-aluminosilicate-microporous structure.

7. The power fuse of claim 1, wherein the molecular sieve material comprises two or more different zeolite materials.

8. The power fuse of claim 1, wherein the molecular sieve material comprises Clinoptilolite.

9. A power fuse comprising:

a housing;

first and second conductive terminals coupled to the housing;

a conductive fuse element in the housing and connected between the first and second conductive terminals, wherein the fuse element facilitates arc division as the fuse element opens in a predetermined overcurrent condition; and an active cooling mechanism filler material surrounding the fuse element in the housing, the active cooling mechanism filler material being formulated to cool the conductive fuse element and reduce thermal-mechanical strain on the conductive fuse element in repeated load current cycling events that are insufficient to cause the fuse element to open, thereby increasing the life expectancy of the power fuse;

wherein the active cooling mechanism filler material includes 100% zeolite material that is hydrated in a selected amount to actively cool the conductive fuse element in the repeated load current cycling events while otherwise maintaining a predetermined melting time-current characteristic of the conductive fuse element in response to the predetermined overcurrent condition.

10. The power fuse of claim 9, wherein the 100% zeolite material includes a first zeolite material and a second zeolite material different from the first zeolite material.

11. The power fuse of claim 9, wherein the 100% zeolite material is Clinoptilolite.

12. A method of making an electrical power fuse including a conductive fuse element extending internal to a housing between first and second conductive terminals, the method comprising:

surrounding the fuse element in the housing with an active cooling mechanism in the form of a filler material including 100% zeolite material that is hydrated in a selected amount to actively cool the conductive fuse element and reduce thermal-mechanical strain on the conductive fuse element in repeated load current cycling events that are insufficient to cause the fuse element to open, thereby increasing the life expectancy of the power fuse while otherwise maintaining a predetermined melting time-current characteristic of the conductive fuse element.

* * * * *